US006220723B1

(12) United States Patent
Freeman et al.

(10) Patent No.: US 6,220,723 B1
(45) **Date of Patent: *Apr. 24, 2001**

(54) WRITABLE DISK SIGN

(75) Inventors: Timothy A. Freeman; Veso S. Tijanic, both of Mississauga (CA)

(73) Assignee: Mark IV Industries Limited, Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/294,314

(22) Filed: Apr. 20, 1999

Related U.S. Application Data

(63) Continuation-in-part of application No. 08/971,192, filed on Nov. 17, 1997, now Pat. No. 6,000,812.

(51) Int. Cl.[7] ..... F21V 1/00

(52) U.S. Cl. ..... 362/240; 362/812; 362/802; 362/252; 362/800; 362/249; 362/277; 40/546; 40/477; 40/479

(58) Field of Search ..... 362/812, 802, 362/252, 800, 249, 277, 240; 40/546, 477, 479

(56) References Cited

U.S. PATENT DOCUMENTS 5,640,792 * 6/1997 Smith et al. ..... 40/546
5,793,343 * 8/1998 Hart et al. ..... 345/84
6,000,812 * 12/1999 Freeman et al. ..... 362/249

* cited by examiner

*Primary Examiner*—Sandra O'Shea
*Assistant Examiner*—Ali Alavi
(74) *Attorney, Agent, or Firm*—Dowell & Dowell, P.C.

(57) ABSTRACT

An array of disks facing a viewing direction is composed of disks rotatable about an axis approximately perpendicular to the viewing direction between alternating orientations where light and dark surfaces are respectively displayed in the viewing direction. There is provided a row of LEDs located forwardly of the array and out of the normal viewing path located to illuminate the disks of said array. Masking means prevents direct illumination from said LED's being visible in the viewing direction. In a further variant the disks' light surfaces contain a fluorescent component and the LEDs are selected to provide radiation including UV spectra.

30 Claims, 9 Drawing Sheets

WRITABLE DISK SIGN

This application is a Continuation-in-Part of application Ser. No. 08/971,192 filed Nov. 17, 1997, and now U.S. Pat. No. 6,000,812.

This invention relates to novel means for illuminating an array of flip disks using LEDs to improve the contrast and therefore the legibility. The novel lighting design is particularly suitable for an array surrounded by its own housing, such as some vehicle's destination signs, since it allows the physically forward side of the array to approach closer to the front transparent wall or the windshield of the vehicle than many prior designs, thus widening the viewing area. The design also lends itself to retro-fitting of an array with flip disk forward facing surfaces, formerly lit by fluorescent lamps.

The following abbreviations are used herein:

LED—light emitting diode

PCB—printed circuit board

PWB—printed wiring board. This is a synonym for PCB

LED lamp is a lens combined with the LED to shape the LED radiation beam.

'Lamp' herein means LED lamp

Flip disks are those approximately flat disks often used in an array for conveying changeable information, which disks display contrasting visual appearances on opposite surfaces and selectively individually move between limiting positions to display selected surfaces in the forward direction.

A fluorescent component of a surface is a component which emits a radiation spectrum while stimulated by incident ultra violet radiation. Such components are well known to those ordinarily skilled in the art.

'Forward' is a direction from the array toward the intended viewer location and 'backward' is the opposite direction.

The direction from the viewing location to the forward side of the array is referred to as the intended viewing direction.

A 'side' refers to any other edge of the active elements (considered collectively) in an array.

A 'group' of LEDs is intended to include a row of LEDs but to also to include other arrangements.

The array of display elements can be generally planar, but if curved ( as in some vehicle destination signs) can still be thought of as defining a median plane.

The array is considered as viewed in the intended viewing direction and is generally of rectangular form having top, bottom and sides.

'Contrasting surfaces' refers to the relation of the opposed surfaces of the flip disks which give some kind of differing visual impression. Thus the opposite surfaces may be light (which may contain a fluorescent component in one variant of the invention) and dark (usually a bright yellow and a dull black). However in one aspect of the second variant of the invention the two opposite sides may have the same hue but one surface only has a fluorescent component which glows (hence 'contrasts' with the other) under UV radiation.

'Intended viewing location' is that area from which the array, as a whole is intended to be viewed. Thus the viewing location may for example be narrow, be the width of a highway or of a parking lot depending on the function of the array.

In comparison with fluorescent tubes for illuminating the disks, LEDs are solid state devices with a lifetime much longer than fluorescent tubes. LEDs require no ballasting and the power required is much less for LEDs than for fluorescent tubes of comparable intensity.

A first variant of the invention has an array of display elements contained in a housing arranged to face a viewing location. The forward surface of the disks is illuminated by LEDs emitting visible radiation backwardly onto them. The LEDs are masked from the viewer. The reflection or lack of it from the forward faces of the disks defines the appearance of the array.

Moreover recent developments in LED technology have introduced higher intensity LEDs and a broad range of color selection and radiation angle. Color selection in the first variant of the invention where the radiation is in the visible spectrum and the disk first surfaces are merely reflective is usually chosen to approach, as closely as possible the color of the first surface of the disk elements. In accord with the first aspect of the invention a plurality of LEDs extends along one side of an array and forward of the median plane, but clear of the intended viewing path from the viewing location to the array. With reflective only light sides there is preferably a row of LEDs located outside opposed boundaries of the array. The LEDs are directed and selected to illuminate the array of elements relatively evenly. The radiation cones of the LEDs are also selected for best even illumination across the array. Masking means prevent direct viewing of the LEDs by a viewer looking from the viewing location.

The array is composed of a number of disk elements rotatable about an axis approximately transverse to the ordinary viewing direction. With such disk elements one usually displays a light or dark surface when facing forward.

Such disk elements may be of several types including those pivoting on an approximate median such as those shown in U.S. Pat. No. 4,860,470 Browne or U.S. Pat. No. 4,577,427 Browne or may be edge mounted as exemplified by U.S. Pat. No. 4,528,932 Ducza et al, U.S. Pat. No. 3,916,403 Mandzu et al or may be board mounted arrays such as in U.S. Pat. No. 5,809,675.

Thus, the radiation directed from the LEDs is reflected from the disk light sides, some of it in the viewing direction, to improve the clarity and appearance of the sign for viewing. In a first variant of this invention the clarity of the array information is enhanced if the color of the LED illuminating radiation is close to that of the disk light sides.

With the first variant of the invention, it is found that particularly good results are obtained when the illumination of the display elements is by two groups or rows of LED lamps located on each of the opposite sides of the array, as viewed from the viewing location. Thus, a mask plate may be located to prevent radiation from each row or group of the LED lamps toward the viewer.

There are prior arrays in a transparent front housing, where the then forward sides of the disks are lit by fluorescent tubes. The invention may be retrofit into such housing by removing the fluorescent tubes and installing opposed rows or groups of LEDs in the casing, clear of the intended viewing lines from the viewing location. Masking plates are then provided on the housing if not already there to mask the LED lamps from the viewer.

Printed circuit boards are particularly suitable for mounting the LED lamps and the energizing conductors therefor in the first variant of the invention, LED lamps in opposed groups and preferably rows, located on mutually opposed sides of a rectangular array lend themselves to location and direction to produce relatively even illumination. In one arrangement the LEDs in an opposed row include a set which illuminates a region of elements near the nearer edge of the array and a set which illuminates a central region of the array. The interleaving of the two sets in each of the opposed rows may thus be arranged to so that one set illuminates the disk forward faces nearer that one of the opposed rows and the central areas between the side strips in a relatively even manner.

LED lamps in this arrangement have a predetermined beam cone angle. Thus, in relation to the arrangement described in the previous paragraph, those LEDs in the set used for (primarily) illuminating elements adjacent the near boundary have been found effective with the LED lamps selected to have a cone of preferably between 15° and 25° included angle, while the LED lamps used for (primarily) illuminating the middle region have, been chosen with radiation between 35° and 45° included angle.

In the second variant of the invention there is an array of flip disk elements which are each provided with opposing first and second surfaces where the first surface includes fluorescent materials in its coating. LED lamps are provided for illuminating the array on the forward facing surfaces. The radiation from the LED lamps causes the first surfaces to fluoresce. There is thus created increased contrast between the viewer-visible first and second surfaces. Fewer LEDs are usually required than with the first variant. Thus usually a row of LED lamps is only required outside one boundary of a second variant array in many embodiments.

Quite often the rotation angle of the disk may be somewhat less than 180° and the stopped portion of the disk is forward of the plane of the array usually in both first and second orientations. Thus the elements in the array are arranged so that the first surface when facing forward is tilted somewhat toward an LED lamp row. This increases the forward looking first surface areas receiving UV radiation and the contrast between first and second surfaces in the array. An increase of contrast is also achieved if the plane of the array and or the beam angle direction of the LEDs are tilted to increase the area of the first surfaces receiving the LED beams. Conversely, the tilt of individual disks or of the array of disks to lessen the angle between the forward looking second surface areas and the LED radiation beam direction reduces the amount of LED radiation reflected from the forward facing second surfaces toward the viewer, again increasing the contrast and the clarity.

FIG. 1 is a somewhat schematic perspective of a casing containing an array in accord with the first variant of the invention, FIG. 2 is a schematic front view of the casing and array showing exemplary sections of the radiation cones from LED lamps arranged and focused to illuminate the forward surfaces of display elements both in the array regions near respective rows of LEDS and in the array region between the LED lamps.

Figure 6:
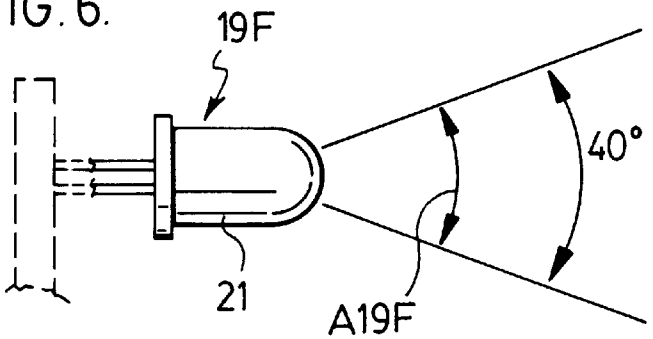

FIG. 6 demonstrates a LED lamp for producing a radiation cone for illuminating the array central region.

Figure 7:
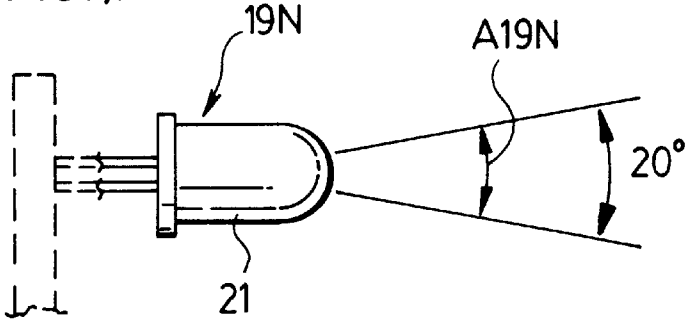

FIG. 7 demonstrates a LED lamp for producing a radiation cone for illuminating edge adjacent regions.

Figure 8:
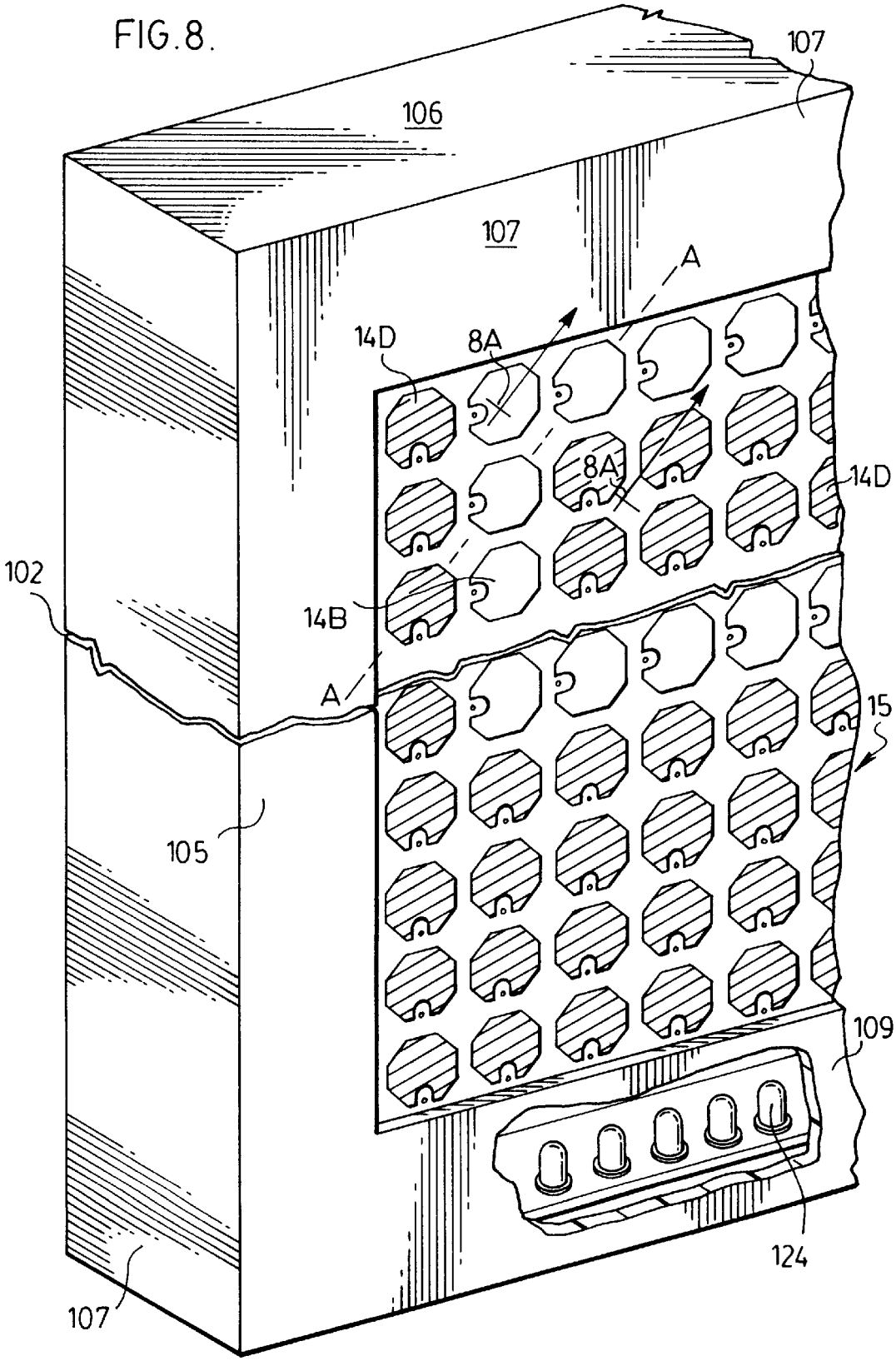

FIG. 8 is a somewhat schematic perspective in accord with the second variant of the invention.

Figure 8A:
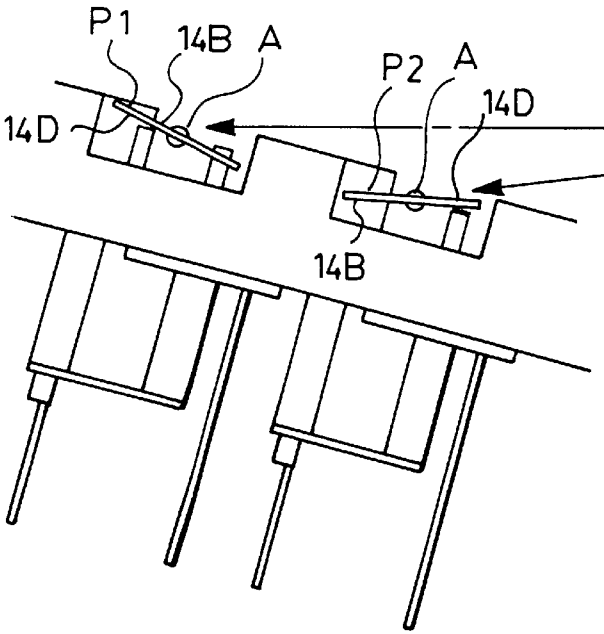

FIG. 8A is a section along the lines 8A—8A of FIG. 8.

Figure 9:
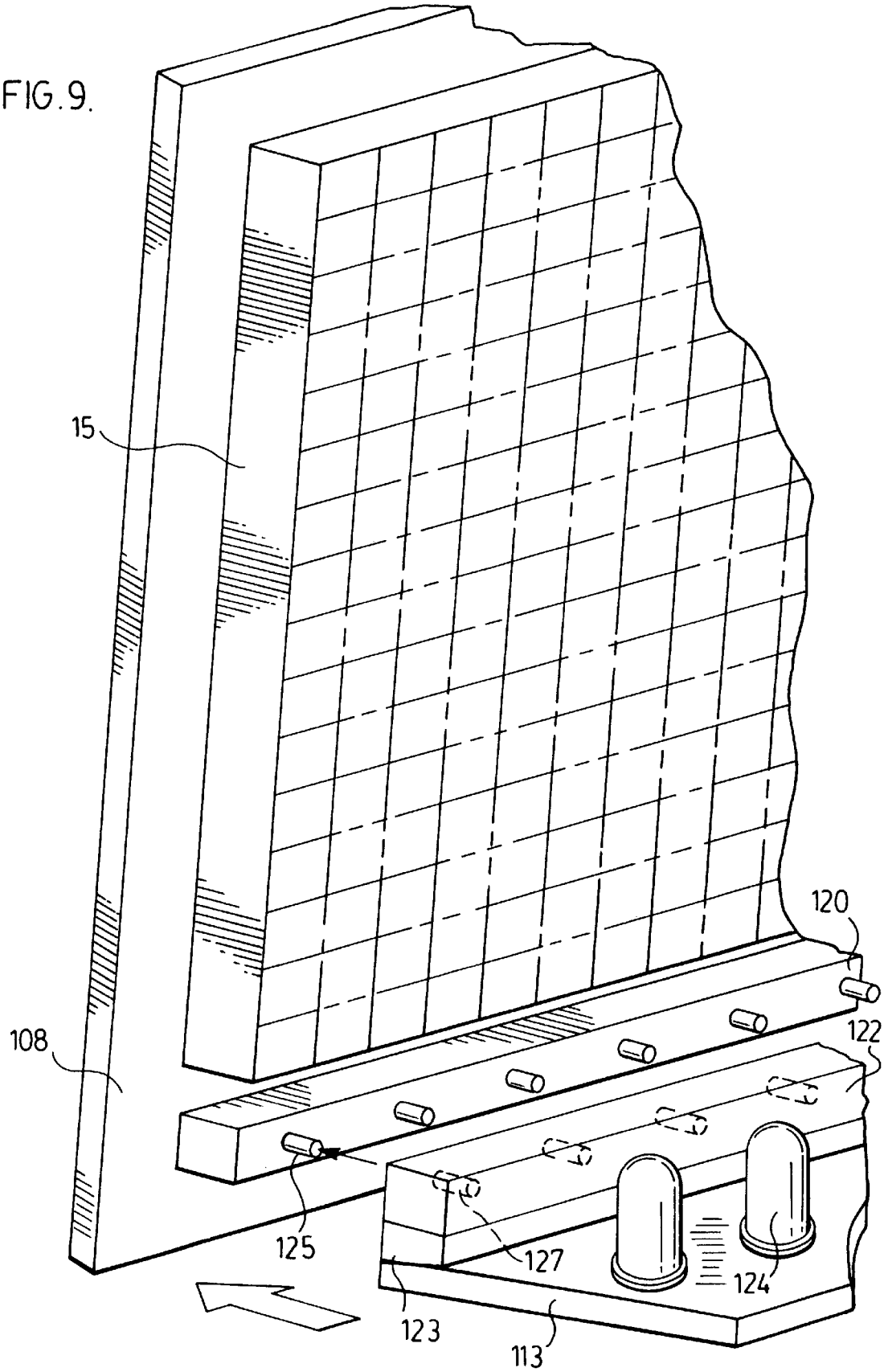

FIG. 9 is a detailed view showing a preferred means for supporting the LED lamps relative to the array.

Figure 10:
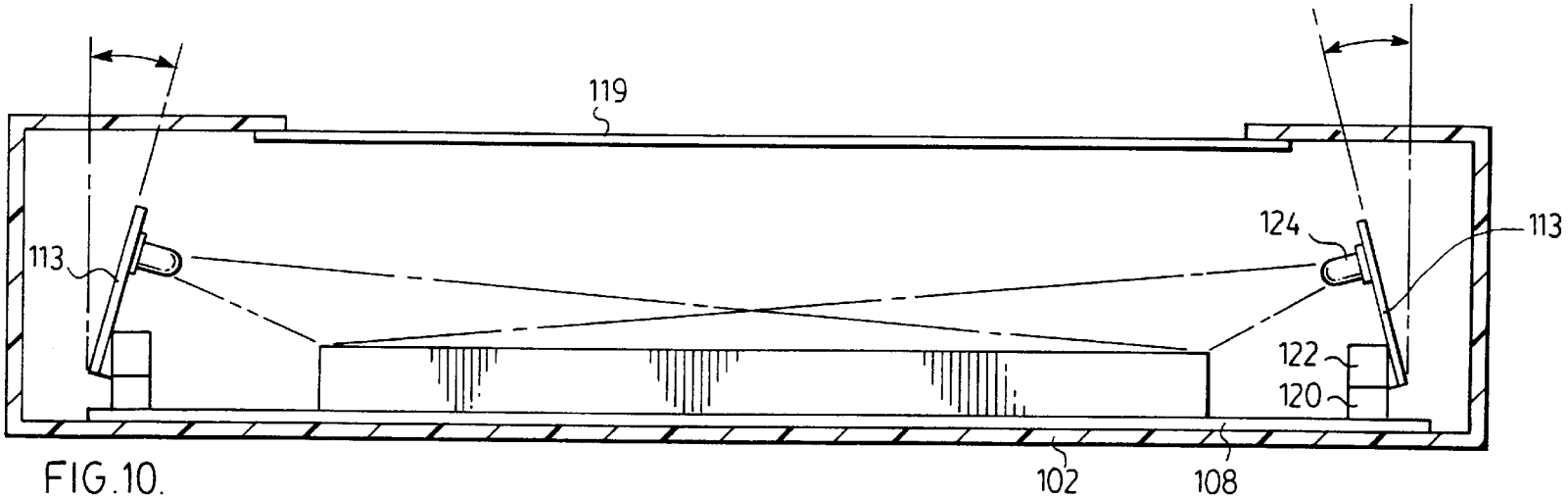

FIG. 10 is a vertical section through the array and the casing of a type of second variant using upper and lower rows of LED lamps.

Figure 11:
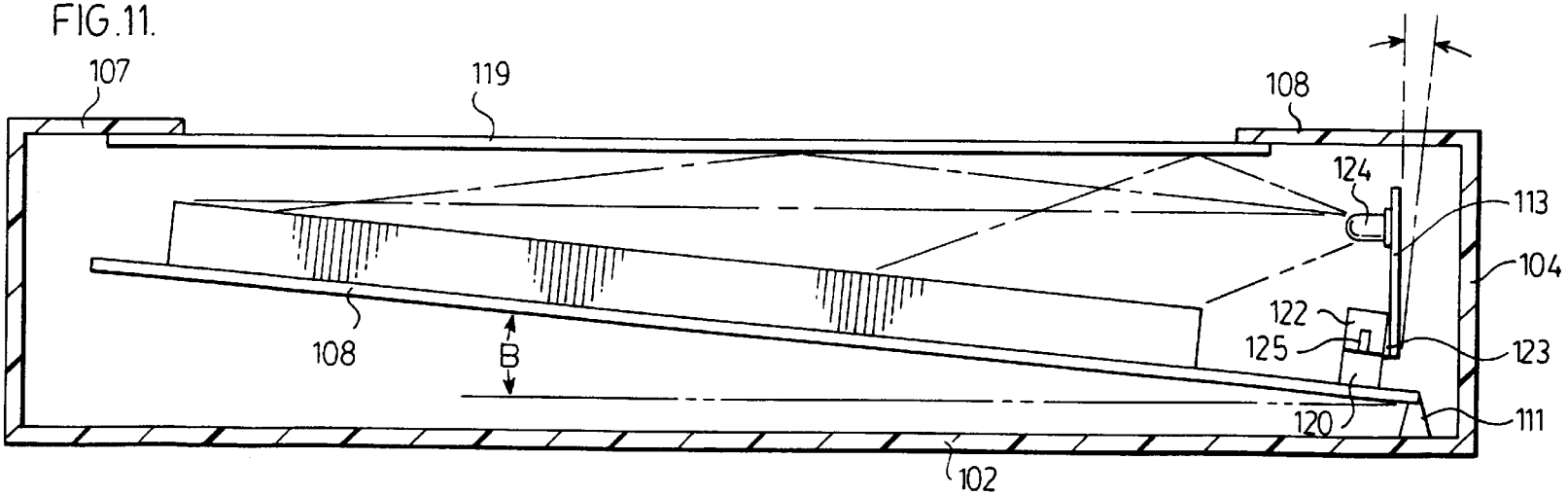

FIG. 11 is a vertical section through the array and the casing of a different type of second variant using only one side (here lower) rows of LED lamps.

Figure 13:
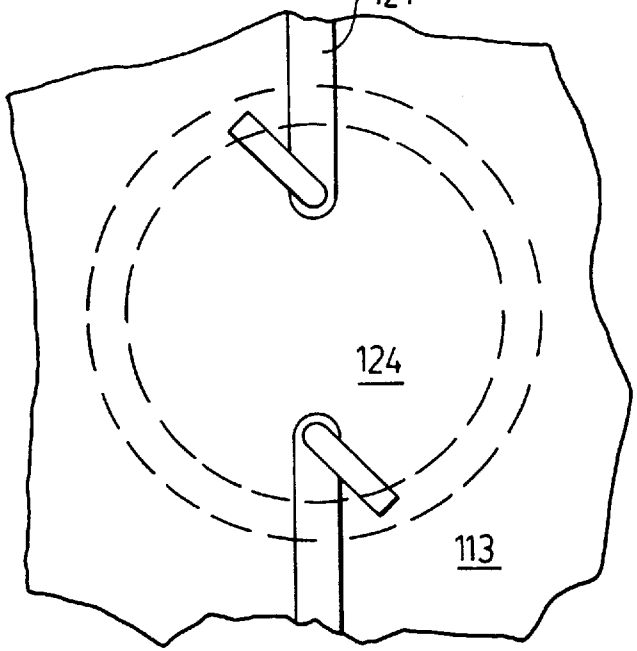
Figure 12:
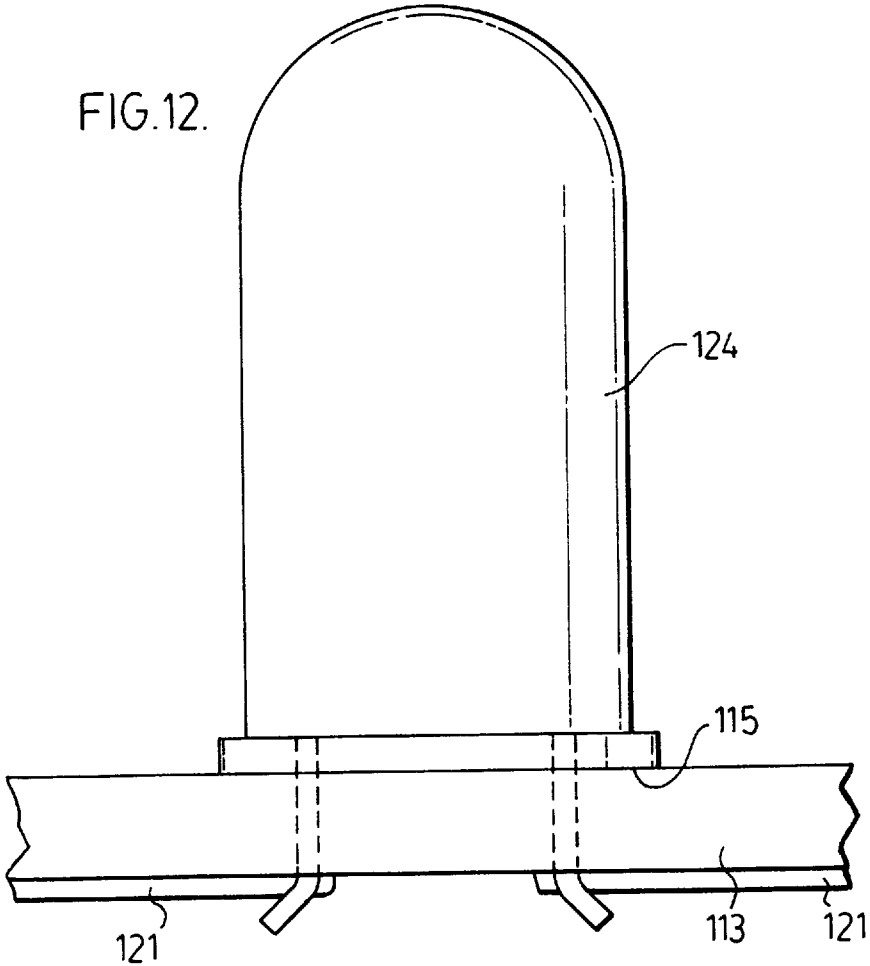

FIGS. 12 and 13 shows detail of flush mounted LED lamps.

Figure 14:
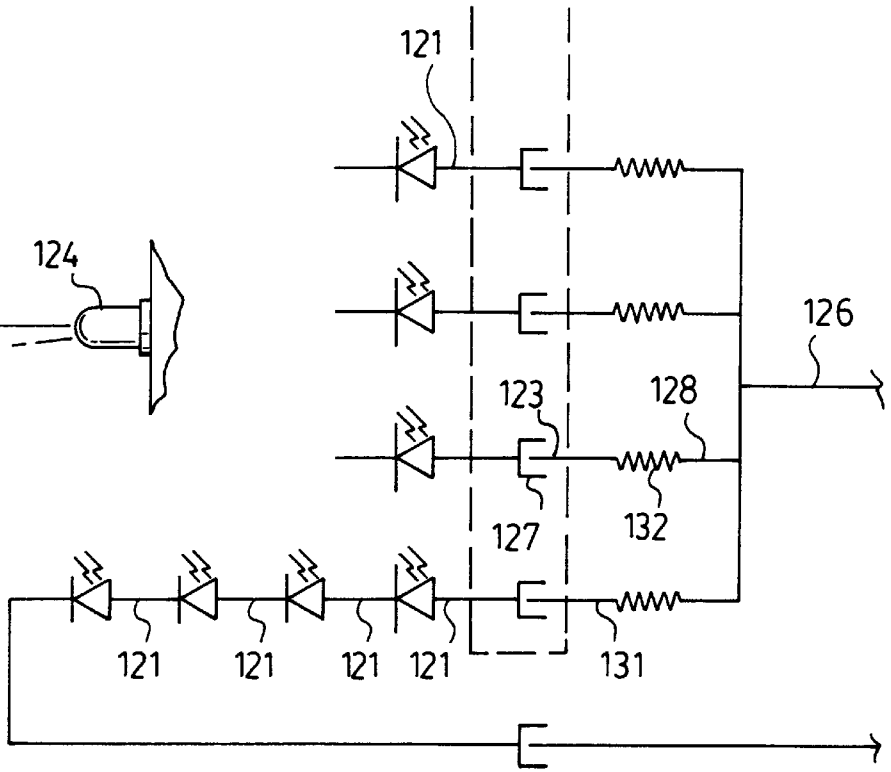

FIG. 14 shows schematically a wiring circuit for the LED lamps.

FIGS. 1–7 show the first variant of the invention including a housing 11 including side walls 10, a back wall (not shown) and glass front pane 12. The housing contains an array 15 with horizontal rows and vertical columns of flip disks 14 which are individually electromagnetically operable to show a light surface 14B or a dark surface 14D to the viewing location for viewing along vectors around direction V. The array forms a rectangle as viewed from the viewing location and the boundaries of the rectangle are framed by walls 17 which prevent radiation from the LED lamps travelling directly to the viewer.

The flip disks are usually electromagnetically operated in accord with well known techniques. Flip disks which operate in this way are disclosed, for example in the U.S. patents listed on Page 3.

However, some of the patents will indicate use of LED lamps or fibers forming part of the individual display element to augment the visual effect or reflection intensity of the light surface 14B of the disk. These LED lamps forming part of individual display elements are not required with this invention because light on the forward facing disk surfaces from the LED lamp rows is provided. Lighting of the light surface of the disks when they are forward facing is also shown in several issued patents corresponding to U.S. applecation Ser. No. 08/644,246 and by File wrapper continuing application Ser. No. 08/958,876. However this patented arrangement requires a LED lamp for each disk which is expensive.

In accord with the preferred form of the first variant of the invention, some disks 14 are shown displaying their light sides 14B with the exception of fourteen disks displaying their dark side 14D in the upper left comer of the array which collectively form an F against 'background' of the light side disks 14B.

The operation of the disks forming the array will not be described since this is well known to those ordinarily skilled in the art. Normal operation is electromagnetic, although other drives may be used.

The housing 11 may in some cases previously have formerly housed a pair of fluorescent tubes located to light an array of display elements located where array 15 is now. Thus if this is a 'retrofit' the former housing for the array has been used after the fluorescent tubes were removed.

The housing thus comprises the side walls 10, and bottom walls, not shown, with a glass pane 12 and a frame of walls 17 (viewer's right wall not shown) which upper and lower walls 17U and 17L are masks as hereinafter described.

Between the plane of the array 15 and the glass pane 12 measured in the forward-rearward direction are located opposed rows of LED lamps 19 for illuminating the array as hereinafter described. The array forms a rectangle as viewed from the viewing location and from this location the LED lamps are located to be outside the array shape thus viewed.

Whatever the array shape is, the frame walls 17 (or one or more of them) are located between the LED lamps and the viewing location so that direct light from a LED cannot be seen by a viewer at said viewing location.

Preferably a row of LED lamps is provided on each of the opposed wider boundaries of the array (as viewed from the viewing location). The opposed rows will usually be chosen to face each other across the array's narrow dimension. The LED lamp rows are located forward of the plane of the array and clear of the array section as seen by viewers looking in the viewing direction from the intended viewing locations.

Preferably the LED lamps are mounted on PCBs 18. The PCBs are very suitable for carrying the wiring (not shown) for the LED chips (not shown) and for mounting the LED lamps. The LED lamp thus comprises an LED (not shown) and a lens 21.

Each LED lens 21 may be selected to define a desired cone for the corresponding LED radiation.

The glass pane 12 usually protects the array by closing off the front of the housing.

LED lamps 19N and 19F form part of the each of lamp rows RL and RF respectively.

Many different arrangements of the LED lamps and lenses may be used to give substantially even illumination to the then forward facing surfaces of the array disks.

An arrangement which has been found useful to produce good results uses a first set of LED lamps in each row which are focused and directed to cover an area of the array near the row and a second set of LED lamps in the same row is interleaved with the first and focused to cover a central area. The opposed row has the some arrangement reversed to complement the first.

Figure 2:
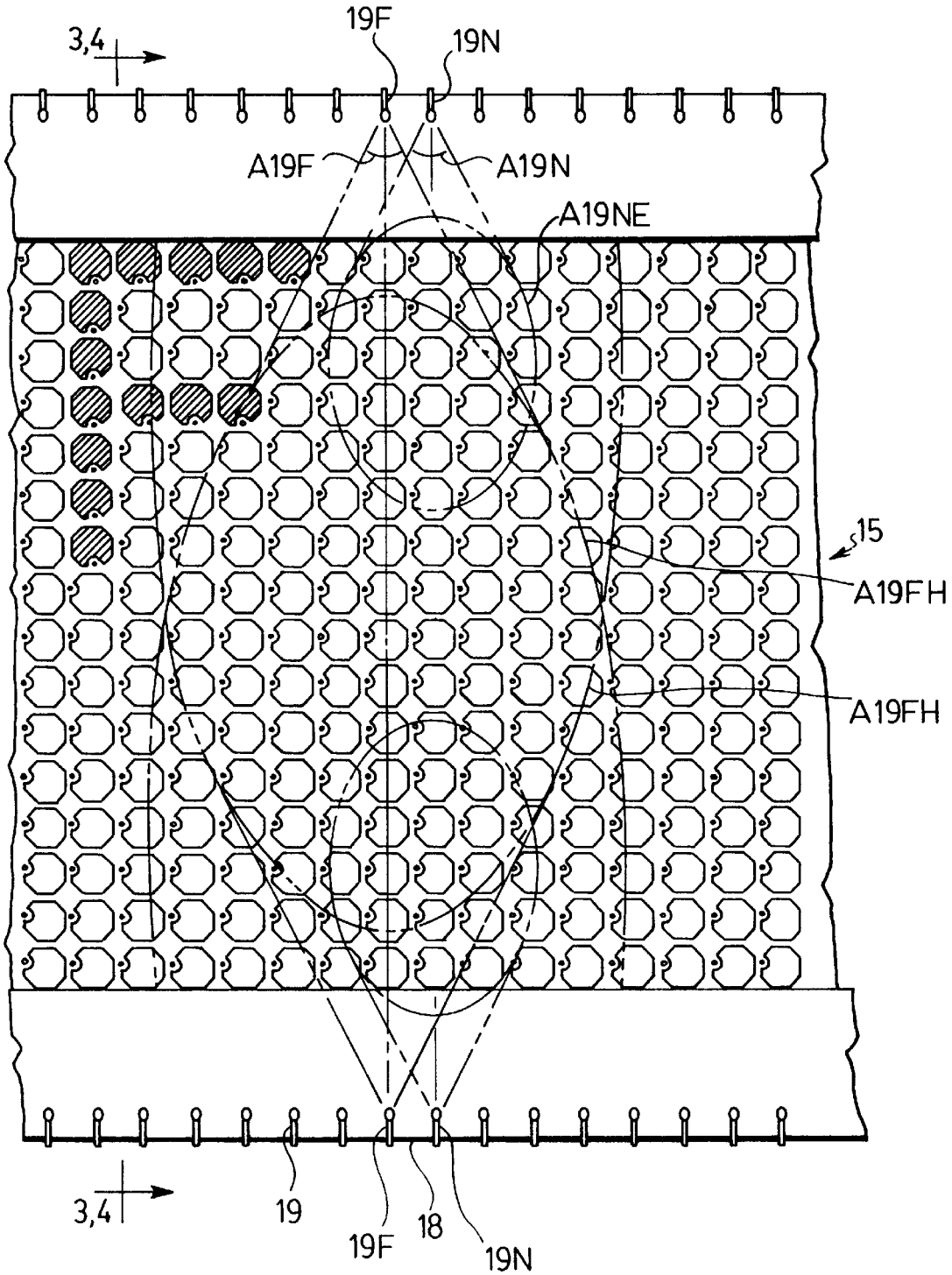
Figure 3:
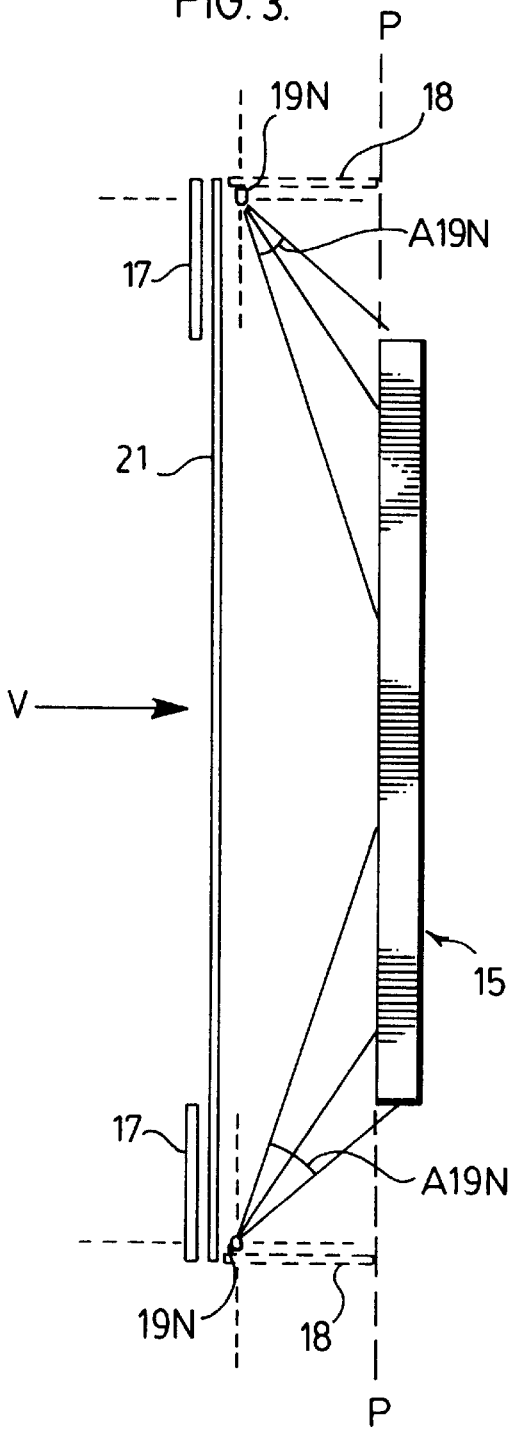
FIG. 3 is a section along the lines 3, 4-3, 4 of FIG. 2 showing the boundaries, in section, of radiation cones from the LED lamps used to illuminate regions of the array near respective illuminating LED lamps.

Thus as shown in FIG. 7 LED lamps 19N may illuminate the array with a beam having a 20° included cone angle A19N whose axial sections are shown in FIG. 3 whose projection on the plane of the array P—P is shown in FIG. 2 as ellipses A19E.

Figure 4:
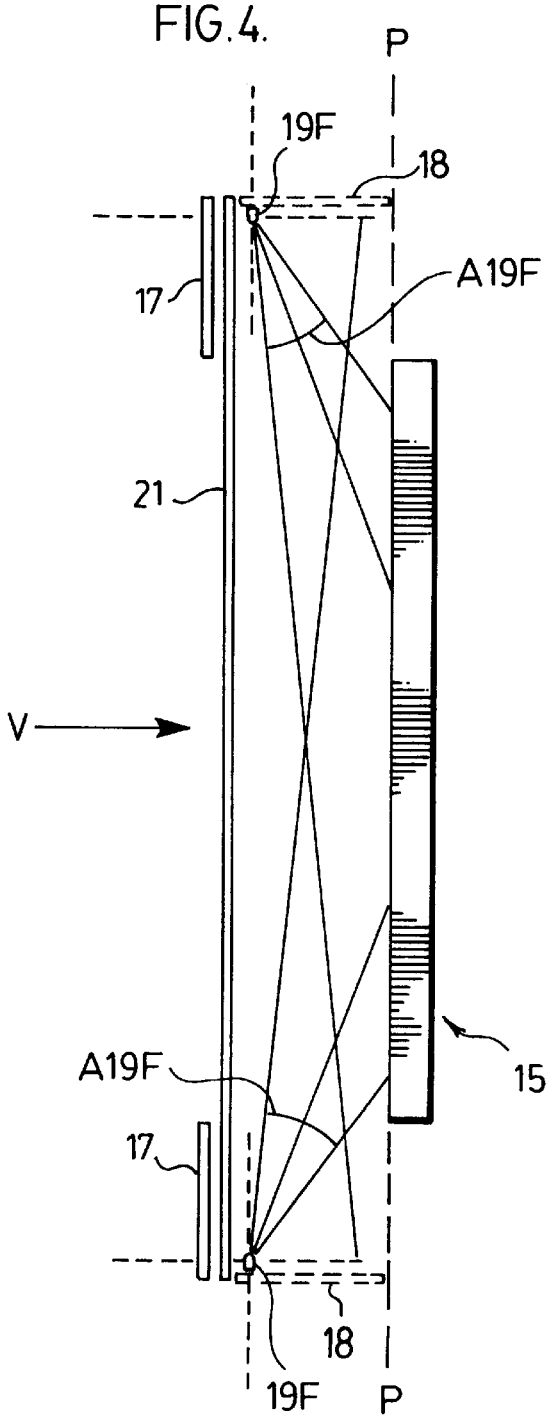
FIG. 4 is a section along the lines of 3, 4-3, 4 of FIG. 2 showing the boundaries, in section, of radiation cones from the LED lamps used to illuminate regions of the array, approximately midway the rows of illuminating LED lamps.
Figure 5:
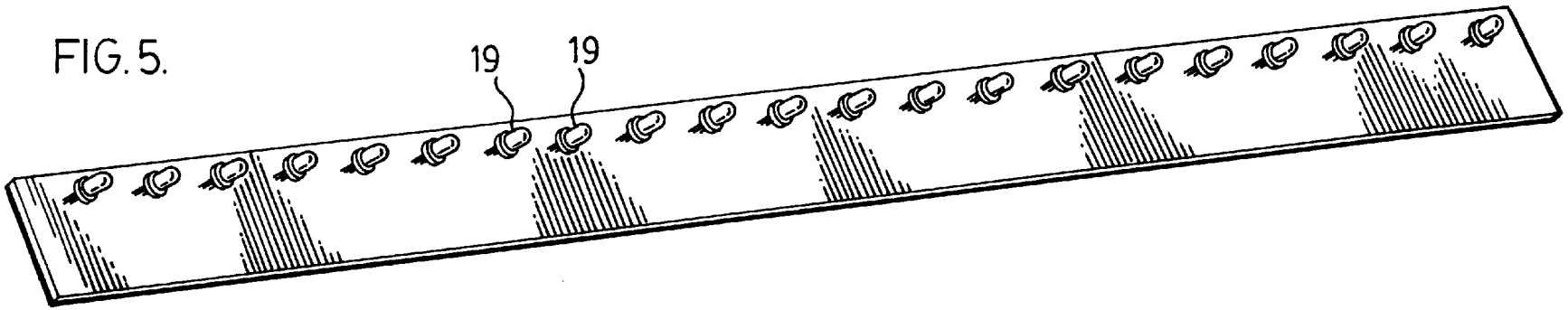
FIG. 5 shows a row of LED lamps on a PCB for illuminating the forward facing surfaces of the array.

As shown in FIG. 6, LED lamps 19F may illuminate the array with a beam having 40° included cone angle. The sections of the lamp 19F cones on the plane of the array P—P are shown in FIG. 4 as hyperbolae A19H.

Thus with the lenses of the LED lamp selected and focused as indicated, the sets of LED lamps 19F and 19N on each side of the array are located and directed to collectively produced approximately equal illumination. LED size and energization may also easily be selected.

The invention is not limited to a particular arrangement or combination of illuminating LED lamps but the discussion demonstrates the wide availability of approaches which may be taken with the inventive arrangement.

With whatever type of lighting is selected the rearwardly shining LED lamps are located outside the boundaries of the array, as viewed from the viewing location and a mask or masks are arranged so that anyone within the viewing location may not see the LED radiation directly.

Figure 1:
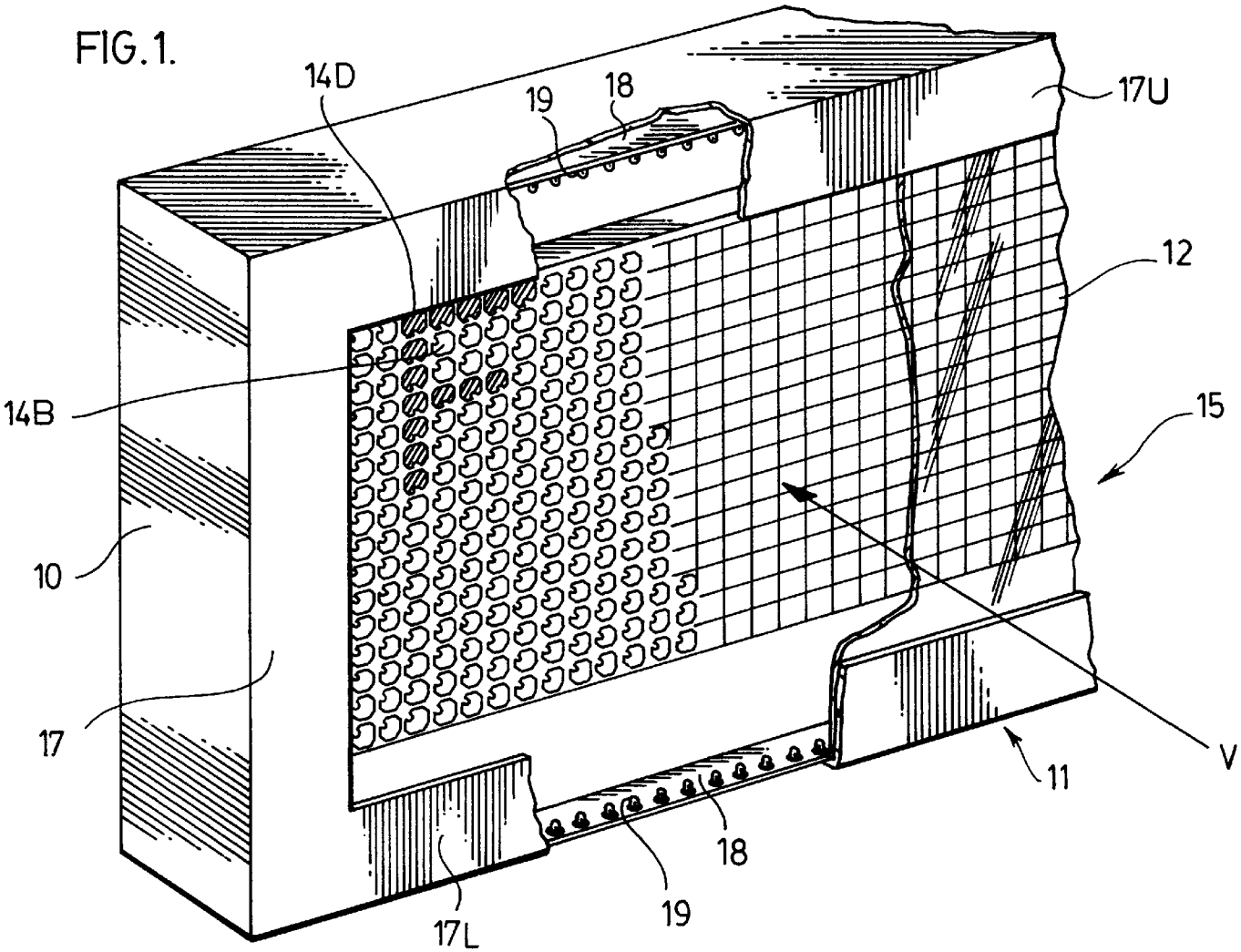

In the second variant of the invention the flip disks 14 of FIG. 8 are shown in somewhat similar arrangements to the disks of FIG. 1. However it will be realized that the shape of array, housing and associated components of either variant may be varied widely within the bounds and parameters determined by the claims.

In the embodiments of FIGS. 8 and 11, (one arrangement of the second variant), the rectangular housing comprises a rear wall 102, side walls 107' and FIG. 8 shows an end wall 106. A front frame 105, 107, 109 (the side opposite to 105 not shown) forms a border around the array as viewed from the viewing location and, in the direction of viewing, the upper and lower frame walls 107 and 109 of the frame act as masks to prevent viewers directly viewing of LED lamps from behind the masks. The end frame wall 105 (see FIG. 8) and its opposite not shown, may also act as masks if required by the lamp arrangement.

The mounting or motherboard 108 for the array is part of mounted on the rear housing wall 102 by means 111 not shown specifically. The disks (see FIGS. 8, 8A) forming the array rotate on an axis A—A approximately transverse to the viewing direction and have first and second surfaces with respectively dark and light surfaces 14D and 14B. The light surfaces, 14B are coated with a light color material including a fluorescent material.

The mounting board 108, or PCB, also known as a motherboard, must mount the PCB (daughterboard) 113 at the correct angle so that the lamps flush-mounted on daughterboard 113 are aimed so that their beams illuminate the disk forward surfaces on the array. Thus the motherboard mounts bracket 120 with upwardly directed probes 125 (see also FIG. 9). Bracket 122 has downwardly directed sockets 127 which severally receive probes 125. Any suitable means, including a wedge shaped bracket such as 123 is used to set the desired angle between the daughterboard 113 and the perpendicular to motherboard 108. The daughterboard 113 mounts a row of LED lamps 124. These are flush mounted as demonstrated in FIGS. 12 and 13. This is aided if the lamps have flat bottoms 115. Thus between the probe and socket brackets 120 and 122 and the flush mounted LED lamps 124 and bracket the lamp beams may be aimed sufficiently accurately to illuminate the disks of the array. Thus a row of LEDs on each daughterboard 113 are found sufficient with the second variant to provide radiation to the light forward oriented faces.

There are many arrangements using ordinary means which can be used to position the LED lamps and aim their beams. All such variants are considered within the scope of the invention.

In FIG. 10 it is assumed that the array has diagonal axis disks (as indicated in FIG. 8) whose light 14B and dark surfaces 14D are each at their limiting positions as indicated in FIG. 8A. A PCB (often called a daughterboard) 113 mounted on motherboard 108, as herebefore described, is located at both top and bottom of the array, each PCB 113 mounting a row of lamps 124 directed to illuminate the array.

In FIG. 11 it is assumed that the rotational axes of the disks are diagonal (see FIGS. 8 and 8A) and that with its light face 14B facing forward the disk is stopped with its stopped portion P1 (remote from the lamps) tilted forward of the axis while with the dark face facing in the viewing direction the dark portion P2 is nearer the disk and is tilted forward.

While the disks do not rotate on horizontal axes in FIGS. 8 and 8A, the tilt of the light surface 14B increases its projected area for receiving LED lamp rays from the row of lamps below the array and the dark surface decreases such projected area. It may be found, as shown, that the upper row of lamps is not needed.

In addition to tilting the individual disks to increase their first surface area to radiation, it is further suitable as shown in FIG. 11 to mount the array (by means not shown) so that the upper part of the plane of the array is forward of the bottom as defined by the angle B to face downward. This further increases the area of the disks forward facing light surfaces 14B, for incident LED radiation and provides the opposite tilt relative to the LED beams when the second surface is forward and it decreases the radiation undesirably reflected by the disk forward facing dark surfaces 14D.

FIG. 11 further demonstrates that when the housing has a forward glass pane 119, its glass rear face may be utilized to reflect some outwardly directed LED radiation back toward the array. In general the display element may have many axial orientations for its disk including: the diagonal shown, the opposite diagonal, horizontal and vertical and each of these may have the light side forward or dark side forward stopped at angles in two senses to the plane of the array. For whatever disk design and tilt is used there will be a LED lamp array which increases the area of light side 14B and/or decreases the area of the dark side 14D to incident lamp rays and all such possible arrangements are within the scope of the invention.

The axes of the disks conversely can be arranged to tilt to present a larger area to lamp beams from above, in which case a single row of lamps can be provided above the array. It is noted that when the forward facing dark surfaces 14D of the disks are stopped to decrease the amount of dark surfaces if any facing the lamp row (see FIG. 8A), the reflection of radiation from the dark side, to the viewer is reduced.

Foil paths (not shown) on the motherboard 108 but well known in the art typically define paths to the complementary probes and sockets and hence to the daughterboard 113 from the sockets to the LED provide the energization to the LED leads to connect them to an energy source.

The motherboard prongs 123 are electrically connected where desired to the respective daughterboard sockets 127 and also connected to the foil paths 131 (only shown schematically) of the motherboard from the power sources not shown to the daughterboard sockets where the daughterboard paths 121 (only shown schematically) connect to the LED.

The motherboard may contain the sockets and the daughterboard the probes. Any other coupling arrangement or beam angle controlling arrangement may be used.

A schematic of a suitable circuit for LED's is shown in FIG. 14 where path 126 on the motherboard splits into the required number of paths 128. Each path goes through a probe and socket connection to the LEDs (each forming part of a LED lamp 124). The LEDs are connected in series (here 4) with a resistor 132 to avoid overloading of LEDs.

It is desired to discuss some of the LED's which may be used. These presuppose the use of disks whose first or light surfaces 14B are of yellow polycarbonate with a fluorescent component or of another suitable surface with a fluorescent component. There are widely available and may, for example be obtained from General Electric Company under the trademark LEXAN. One alternative to the conventional LED which is currently available is an LED radiating blue light at a peak radiation at 470 nm. This is a deep blue at the end of the visible spectrum together accompanied by a significant component of Ultra Violet (UV) radiation.

We prefer to use an LED radiating white light. Presently white LED's are made in two ways. The one for use with this application is the white color LED containing a substantial amount of UV rays and is made from a blue die mounted on a doped yellow phosphor substrate.

LED's which radiate substantially only UV rays and almost no visible radiation are in the process of development. With such an LED and a disk with a fluorescent surface, there will be no reflected hue and the only radiation issuing therefrom will be that often called 'black light' caused by excited fluorescent material on the forward side 14B. The only contrast of the disk surfaces where both surfaces 14B and 14D may be black, would be the fluorescent component in the surface 14B and contrasting only when the LEDs are on.

From time to time, other LEDs will be developed radiating substantial amounts of UV rays and these may be used within the scope of the invention.

It will be noted that the embodiments of the first variant, shown in FIGS. 1–7 will also operate as embodiments of the second variant if the FIGS. 1–7 disk's bright surfaces have a fluorescent component and the LEDs provide radiation at least partially in the UV spectrum.

Although the LED lamps outside the boundaries of the array are conveniently arranged in rows, the invention relates to groups arranged in other than rows.

What is claimed is:

1. A writable disk sign comprising:

an array of disks each defining a median plane and a viewing direction from intended viewing locations forwardly of said plane, each said disk being rotatable about an axis approximately transverse to the viewing direction, between alternate orientations where bright and dark surfaces are respectively displayed in the viewing direction;

a plurality of LEDs located forwardly of the plane of the array and outside the array as viewed in the viewing direction, said LEDs being located to illuminate the then forward side of the disks in said array; and masking means for preventing direct illumination from said LEDs travelling to said viewing locations.

2. A writable disk sign according to claim 1 wherein the color of radiation from said LEDs approaches the of said bright surfaces.

3. A writable disk sign according to claim 1 having opposite sides and opposite ends as viewed in the viewing direction and having a plurality of LEDs on opposite sides of said array as viewed in the viewing direction.

4. A writable disk sign according to claim 2 having pluralities of LEDs on opposite sides of said array as viewed in the viewing direction.

5. A writable disk sign according to claim 3 wherein each of said pluralities comprises a first set of LEDs arranged to direct radiation toward an outer region of said array near said first set and a second set of LEDs arranged to direct radiation toward a central area between opposite side outer areas.

6. A writable disk sign comprising:

an array defining a viewing direction, said array being composed of disks rotatable to selectively present opposite bright or dark surfaces to an intended viewing location;

a housing for said array visible from the intended viewing location;

a group of LEDs located on at least one side of said array as viewed from said viewing location, and directed to illuminate the forward facing surfaces of said disks; and a masking extent located to block radiation from said LEDs going directly to said viewing location, said masking extent being outside said array as viewed from said viewing location.

7. A writable disk sign according to claim 6 wherein the color of radiation from said LEDs is close to the color of said bright surfaces.

8. A writable disk sign according to claim 6 wherein there are groups of LEDs on each side of the array and wherein each of said groups comprises a first set of LEDs arranged to direct radiation toward an outer area of said array near said fist set and a second set of LEDs arranged to direct radiation toward a central area between opposite side outer areas.

9. A writable disk sign according to claim 7 wherein there are groups of LEDs on each side of the array and wherein each of said groups comprises a first set of LEDs arranged to direct radiation toward an outer area of said array near said first set and a second set of LEDs arranged to direct radiation toward a central area between opposite side outer areas.

10. A writable disk sign according to claim 2 wherein each of said LEDs is combined with a lens to form a lamp and said lamp is mounted on a printed circuit board.

11. A writable disk sign according to claim 6 wherein each of said LEDs is combined with a lens to form a lamp and said lamp is mounted on a printed circuit board.

12. A writable disk sign comprising:

a number of display elements forming an array, each display element controllably movable between a first and a second position where, respectively, first and second contrasting surfaces are displayed to a viewing location, said first contrasting surface having a fluorescent component; and LEDs located outside the array as viewed from the viewing location to shine on those surfaces then displayed to the viewing location;

wherein radiation from said LEDs contains components to cause fluorescence when incident on said first contrasting surface.

13. A writable disk sign according to claim 12 wherein said number of display elements form an array of rows and columns when viewed from the viewing location.

14. A writable disk sign according to claim 12 further comprising masking means for preventing radiation from being radiated directly to the viewing location.

15. A writable disk sign according to claim 12 wherein said first surface comprises a mixture of light and fluorescent material.

16. A writable disk sign according to claim 12 wherein at least some of said LEDs emit radiation containing a substantial deep blue component and an ultraviolet component.

17. A writable disk sign according to claim 12 wherein at least some of said LEDs radiate a color closely approaching white.

18. A writable disk sign according to claim 12 wherein said LEDs radiate radiation consisting essentially of ultraviolet light.

19. A writable disk sign according to claim 12 wherein the semiconductors for said LEDs produce a white color containing a substantive amount of ultraviolet rays.

20. A writable disk sign according to claim 12 wherein said disks are angled toward said LEDs when in said first position to increase exposure of said first surfaces to LED rays, and away from said LEDs when in said second position to reduce exposure of said second surfaces to LED rays, to increase the contrast between the first and second surfaces as viewed from the viewing location.

21. A writable disk sign according to claim 12 wherein the radiation from the LEDs is predominantly ultraviolet, the writable disk sign further comprising a filter forming part of each LED for blocking a large proportion of the rays from the visible spectrum.

22. A writable disk sign according to claim 12 wherein said first contrasting surfaces are light and said second contrasting surfaces are darker then said first contrasting surfaces.

23. A writable disk sign according to claim 12 wherein said first contrasting surfaces are yellow and said second contrasting surfaces are darker than said first contrasting surfaces.

24. A writable disk sign comprising:

an array of display elements, each display element having opposite first and second contrasting surfaces and being controllably movable between first and second positions wherein said first and second surfaces are respectively displayed toward a viewing location;

a fluorescent compound forming part of said first surface;

a plurality of LEDs arranged to illuminate those first and second surfaces displayed toward the viewing location, said LEDs emitting substantial radiation in the ultraviolet band.

25. A writable disk sign according to claim 24 including means masking said LEDs from the viewing location.

26. A writable disk sign comprising:

an array of display elements arranged in rows and columns, said display elements being movable between first and second positions, and displaying a first surface to a viewing location when in said first position and displaying a second surface to said viewing location when in said second position, said first surface including a fluorescent component;

a wall framing said array when viewed in the viewing direction located forwardly of said array; and LEDs mounted to be masked from said viewer by said wall and arranged to radiate directly on the surfaces of elements in said array displayed to said viewing location, said LEDs providing ultraviolet radiation.

27. A writable disk sign according to claim 26 wherein said array is mounted on a first printed circuit board.

28. A writable disk sign according to claim 27 comprising a second printed circuit board mounted on said first printed circuit board and said LEDs are mounted on said second printed circuit board.

29. A writable disk sign according to claim 28 wherein one of said first and second printed circuit boards has mounting prongs and the other of said first and second printed circuit boards has complementary mounting sockets.

30. A writable disk sign according to claim 27 wherein said LEDs are located on a second printed circuit board.

* * * * *